United States Patent [19]

Kovacik et al.

[11] 4,262,327

[45] Apr. 14, 1981

[54] PORTABLE FLUORESCENT TUBE

[75] Inventors: James W. Kovacik; James D. Kovacik, both of Parma; Thomas J. Blanch, Aurora; Paul S. Blanch, Garfield Heights., all of Ohio

[73] Assignee: Alert Safety Lite Products Company, Bedford Heights, Ohio

[21] Appl. No.: 64,490

[22] Filed: Aug. 7, 1979

[51] Int. Cl.[3] ..... F21S 3/00

[52] U.S. Cl. ..... 362/223; 362/362; 362/368; 362/396

[58] Field of Search ..... 362/223, 362, 368, 396

[56] References Cited

U.S. PATENT DOCUMENTS 3,140,054 7/1964 Oharenko ..... 362/223

*Primary Examiner*—Stephen J. Lechert, Jr.
*Attorney, Agent, or Firm*—Wilson, Fraser, Barker & Clemens

[57] ABSTRACT

A portable fluorescent tube assembly is disclosed that is substantially all plastic and comprises improved end socket construction for the tube. In one form, an end socket comprises a support body having openings adapted to make an electrical connection therein with pins of the fluorescent tube. Radially extending fingers on the body tend to center it as desired. A rearward extension of the body has a transversely disposed aperture. Hollow socket members embrace the support body and have connecting sections which meet one another through the aperture of the rearward extension. Fastening means extend through the connecting sections of the socket members and the aperture to hold the socket construction in assembly. Optionally, one socket construction can contain a starter switch for the fluorescent tube and electrical leads needed to energize the tube. Preferably, the electrical plug for the electrical leads and the ballast for the fluorescent tube are combined in one integral unit remote from the tube to relieve the assembly of the weight of the relatively heavy ballast.

14 Claims, 20 Drawing Figures

PORTABLE FLUORESCENT TUBE

BACKGROUND OF THE INVENTION

The present invention relates to a portable fluorescent tube assembly which can be manually moved and suspended about a work site to aid a user to obtain the best lighting conditions. It has been the practice to use incandescent light bulbs, suitably encased in light guards, for this purpose. Such lights are often referred to as trouble lamps, extension lights, work lights, inspection lights, and the like, and are commonly employed by mechanics and other workers who require a concentration of light in a frequently changing location.

Fluorescent lights have several advantages in use as compared with the incandescent bulbs. As an example, for the same wattage fluorescent lights usually provide more light with less glare. In the past, attempts have been made to convert portable lights such as extension lights to fluorescent tubes. However, a number of serious problems have arisen, particularly in attempting to adapt a fluorescent tube to a satisfactory portable assembly. A common complaint is that the electrical connections between a fluorescent tube and its mounting and electrical conductors are not originally, or do not long remain, sufficiently tight to provide desired electroconductivity, especially as compared to the more commonly used incandescent light bulbs. When inadequate electrical contacts occur, fluorescent tubes exhibit disproportionately high electrical resistance.

It is, of course, quite important that a fluorescent tube be firmly mounted and snugly held by its supports, especially if the tube is designed for portable use. While an incandescent bulb has a relatively large area of contact for electrical connection around its threaded base, the usual fluorescent tube has only a pair of relatively fine, fragile pins extending from opposite ends of the tube which constitute electrical terminals. In order to insure a firm and constant electrical connection with the terminal pins, prior socket connections have been quite heavy and cumbersome. In some instances, sockets used for each set of pin terminals are mounted apart facing each other as on a single bracket somewhat longer than the fluorescent tube itself. Such sockets are usually stationary and not movable with respect to each other. This restriction often limits the manner in which the fluorescent tube can be mounted and used.

Additionally, it has been the practice to mount a ballast for the fluorescent tube in-line, that is, in the electrical cord which energizes the tube. The ballast which includes a transformer is normally quite heavy. This adds to the problems of supporting and mounting the fluorescent tube itself. Further, a ballast generates heat in use and the added heat, so generated, can be a problem when adjacent to the tube and its assembly.

These structural problems become even more acute if it is desired to construct a portable fluorescent tube assembly. Portable units are much more susceptible to rough handling. The tube assembly may be dropped or, at a minimum, subject to jarring, vibration, and the like. Such mechanical shocks tend to dislodge or momentarily interrupt an electric current to the tube pins at the opposite ends of the tube and produce a high voltage arc, thereby introducing health and safety hazzards.

U.S. Pat. No. 2,691,092 to McConnell et al discloses a fluorescent work light of shock-absorbing construction in which sockets are vulcanized in the end closures in mutually laterally spaced relationship, the spacing being slightly different from the lateral spacing of the pins or terminal prongs on the fluorescent tubes. When an electrical connection is made, the lateral spring load tends to maintain the pins in much tighter contact with the sockets than is usually the case.

U.S. Pat. No. 4,088,882 to Lewis teaches a fluorescent bike lamp in which end caps are adhesively bonded to ends of the fluorescent tube to maintain the assembly in an integral condition.

U.S. Pat. No. 4,092,706 to Vest discloses a fluorescent light designed to accommodate elongation of a plastic housing due to thermal expansion of the housing to which socket supports are attached. The socket supports include a strip of metal bent into a four-legged rectangular shape. An inner leg is adapted to flex and thereby accommodate expansion and contraction.

SUMMARY OF THE INVENTION

An object of the present invention is to provide a fluorescent tube assembly that has improved socket members for physically supporting the ends of the tube and for making electrical connection therewith. Another object is to provide a shock-absorbing fluorescent tube assembly that holds the tube securely and avoids sparking at the contact ends even though the tube assembly may be jarred or otherwise subjected to a mechanical shock. A further object is to provide a fluorescent tube assembly in which component parts may be easily changed or replaced and that requires less maintenance and service care and expense. A still further object is to provide a strong and durable, self-contained portable fluorescent tube assembly that is simple in design and economic in construction. An additional object is to provide such a portable tube assembly in which the ballast for the tube is sufficiently removed from the electrical cord of the assembly that its weight is not a factor in the use and physical movement of the tube assembly.

In one non-limiting form, the present fluorescent tube assembly comprises a light-transmitting envelope adapted to receive and carry within the envelope a fluorescent tube having electro-connecting means at each end, usually projecting pins or prongs. The assembly has a socket construction for each end of the envelope. Preferably, each socket construction has essentially the same construction and comprises a support body having passages adapted to receive the electroconducting means of the tube and form therein a secure electrical connection. A rearwardly extending ledge on the support body has a transverse aperture. Cup-shaped socket members, preferably two in number, embrace the support body and meet along their edges which extend substantially parallel to the length of the envelope. Each of the mating socket members has hollow connecting sections extending substantially transversely to the length of the envelope. At least one of the connecting sections passes through the aperture of the ledge of the support body and contacts another connecting section of a mating cup-shaped socket member. The connecting sections accommodate fastening means which holds the socket construction in assembly.

The tube assembly may contain suitable electrical leads to energize the fluorescent tube. Such leads may extend to one socket construction and be electrically connected to the electro-connecting means of the tube in the defined passages of the socket. Additional electrical leads extend from that socket construction along the envelope to the other socket construction for electrical connection to the other end of the fluorescent tube.

In a preferred embodiment, one of the socket constructions contains starter switch means electrically connected with the electrical leads to that socket construction. The free ends of the electrical leads energizing the fluorescent tube assembly are adapted to be connected to a source of electrical power, such as by an electrical plug. The electrical circuit also includes a ballast for starting the fluorescent tube in a standard manner. In a preferred embodiment, the electrical plug and the ballast are contained in one integral unit substantially to relieve the fluorescent tube assembly of the weight of the ballast.

Except for metal conductors, fasteners and the like, the components of the present fluorescent tube assembly are practically all plastic, leading to a much lighter assembly. The substantially all plastic construction results as well in a safer assembly less likely to produce inadvertent electrical shocks.

DESCRIPTION OF THE PREFERRED EMBODIMENTS

Figure 1:
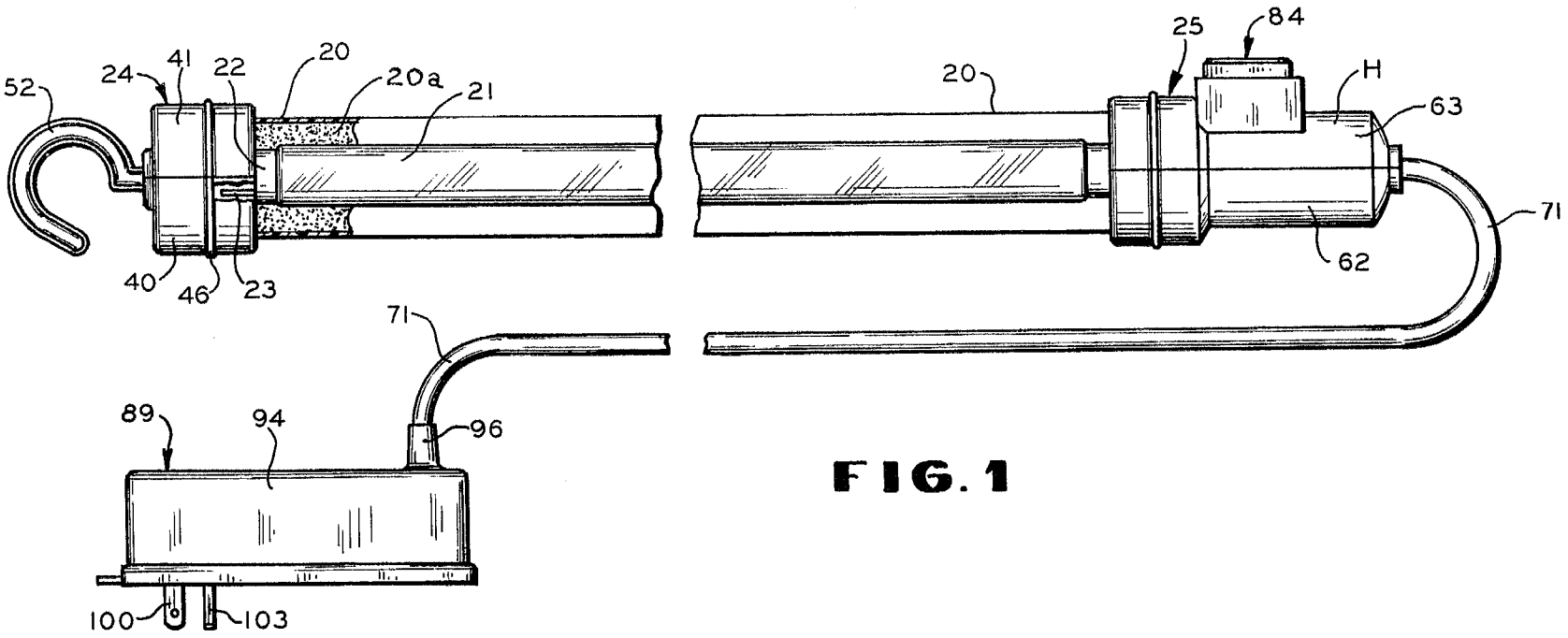
FIG. 1 is a side elevational view, partially in section, of one form of the present portable fluorescent tube assembly.

In one form, the fluorescent tube assembly includes a light-transmitting envelope concentrically containing a standard fluorescent tube. At each end, a socket construction joins the envelope and tube and holds the assembly together. The socket also contains electrical leads for energizing the tube. To this end, one socket construction is enlarged to house switch means and to receive incoming electrical leads. The free or opposite ends of the electrical leads may terminate in an integral unit containing both an electrical plug for connection to a source of electrical energy and a ballast for the fluorescent tube.

Referring to these parts in greater detail, and initially to FIGS. 1 through 11, the illustrated embodiment includes an outer tubular envelope 20 concentrically disposed about a standard glass fluorescent tube 21. Envelope 20 is fabricated from a synthetic plastic as are many of the hereinafter defined parts. When any part is defined as composed of a plastic, the plastic may comprise polyethylene, polypropylene, polybutyrate, nylon, and other like resins which are suitably heat resistant to withstand the temperatures generated by tube 21 during use. Envelope 20 may have a portion of its circumferential distance lightened to form a reflector section **20*a* which intercepts light from tube 21 and reflects it away from section 22. Envelope 20 may be lightened by a strip of reflective metal or foil-covered paper which extends along the inside of envelope 20 between its ends. Or the transparent plastic comprising envelope 20 can be lightened or whitened by a dye or pigment along a selected area. In a preferred embodiment, tube 21 may comprise co-extruded semi-circular sections sealed along their mating edges, one section being transparent and the other section being white and therefore reflective. Tube 21 has metal ferrules 22 at each end from which extend a pair of electro-conducting contact pins 23. Tube 21** can vary as to length and wattage but, for example, may vary between about 12 inches and about 18 inches and be rated at about 8 watts or 15 watts.

Envelope 20 extends beyond each end of tube 21. A cooperating pair of end sockets, generally indicated at 24 and 25, fit about the envelope extensions and hold the envelope and tube together as well as house electric circuitry for the tube. As illustrated by FIGS. 2 through 11, a plastic support body 26 fits within the tubular extension of envelope 20 which passes beyond the end of tube 21 and is adapted to effect electrical connection with pins 23 of the tube as well as aid in holding together the end components of the fluorescent tube assembly.

More particularly, support body 26 comprises a ring 27 having radially projecting fingers 28 which are of a length to reach and contact the inner surface of envelope 20 and thereby position body 26 centrally with respect to the envelope. Fingers 28 also act as shock-absorbers when the tube assembly receives mechanical shock and reduces the likelihood of breakage or other damage to the tube assembly. A diametral section 30 extends across ring 27 and has a pair of substantially parallel passages 31 in which metal, pin-gripping sleeves 32 (FIG. 11) are inserted and held in position by reduced portions 33 of passages 31.

Figure 2:
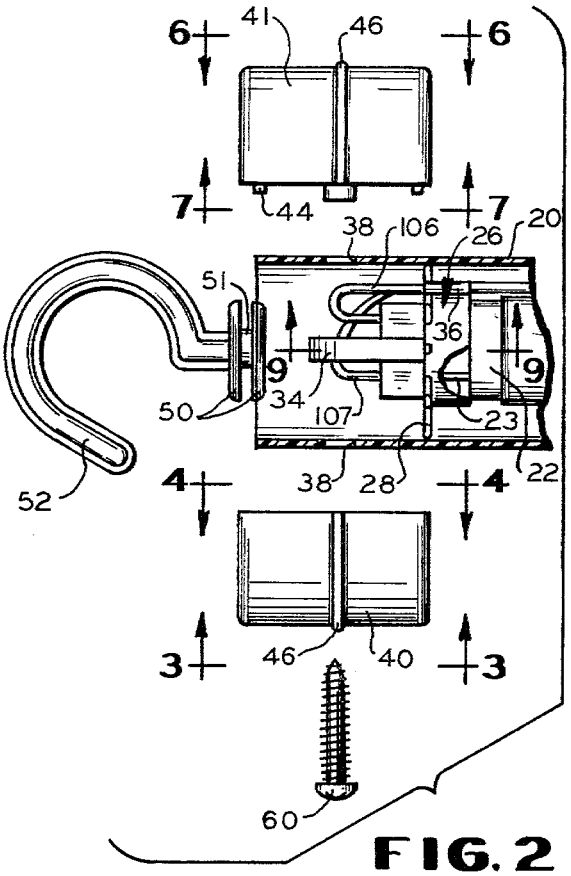
FIG. 2 is an exploded view, partially in section, of the left hand socket construction of the tube assembly of FIG. 1.
Figure 3:
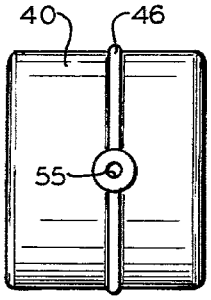
FIGS. 3 and 4 are sections of FIG. 2 on the planes of the lines 3—3 and 4—4, respectively.
Figure 4:
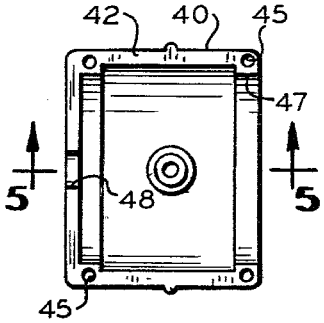
Figure 5:
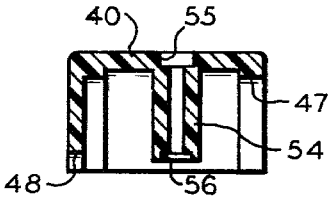
FIG. 5 is a section of FIG. 4 on the line 5—5.
Figure 6:
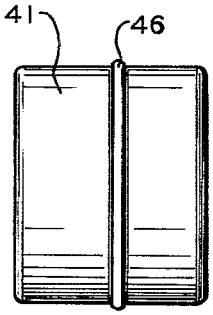
FIGS. 6 and 7 are sections of FIG. 2 on the planes on the lines 6—6 and 7—7, respectively.
Figure 7:
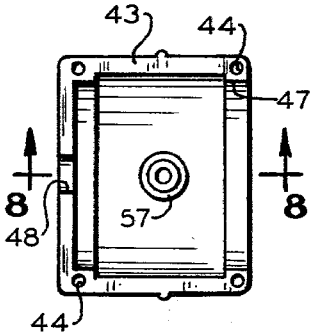
Figure 8:
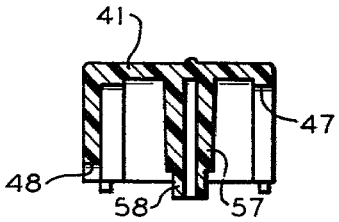
FIG. 8 is a section of FIG. 7 on a line 8—8.
Figure 9:
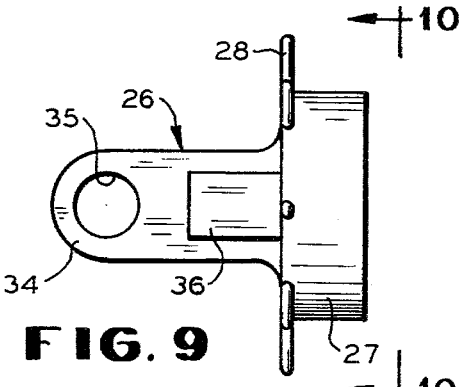
FIG. 9 is a section of FIG. 2 on the line 9—9.
Figure 10:
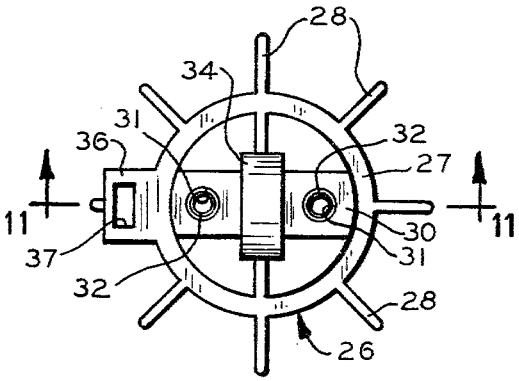
FIG. 10 is a view of FIG. 9 on the plane of the line 10—10.
Figure 11:
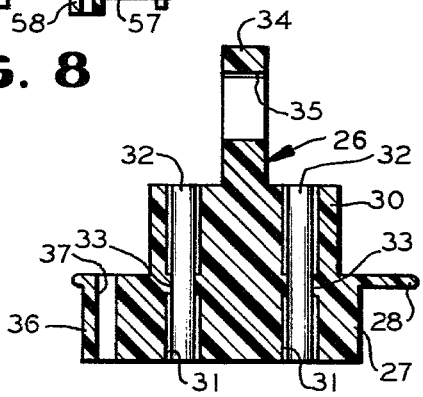
FIG. 11 is a section of FIG. 10 on the line 11—11 and illustrates the presence of metal sleeves which grip electroconnecting pins of a fluorescent tube.

A ledge extends rearwardly of support body 26 and has a transverse opening 35. At one side, body 26 has an enlargement 36 provided with a through passage 37. In use, pins 23 from tube 21 are inserted in the metal sleeves 32 contained in passages 31 of support body 26. Electrical leads 106 and 107 (FIG. 20) extending from the other end of the tubular assembly, as hereinafter more fully described, extend through passage 37 of enlargement 36 and make electrical connection with pins 23 on that side of body 26 having ledge 34, as illustrated in FIG. 2.

End socket 24 includes a pair of plastic mating caps or cup-shaped socket members 40 and 41. Each socket member is semi-circular to preserve the circular configuration of the assembly and has a flat, rectangular face shown at 42 and 43, respectively. Socket members 40 and 41 have mating portions to aid in meeting and registering the socket members with one another along the edges of faces 42 and 43. In the illustrated embodiment, cup-shaped member 41 has a projecting pin 44 at each corner of its face 43, while cup-shaped member 40 has a matching recess 45 at each corner of its face 42 to receive the pins 44.

Each socket member 40 and 41 has a circumferentially extending reinforcing rib 46 and together form matching end bores. Bore 47 is larger and of a size to fit tightly around the outside of envelope 20. Bore 48 is much smaller and of a size to fit between flanges 50 on a stem 51 of a plastic hook 52 and thereby lock the hook to the assembly. By means of hook 52, the assembly may be suspended at a desired location such as a work site. Bore 48 is sufficiently oversized to permit the stem 51 of hook 52 to turn 360° about an axis defined by stem 51, so that the assembly can be conveniently rotatably positioned with respect to the hook 52 which remains in a stationary position.

An important function of the cup-shaped socket members 40 and 41 of end socket 24 is to hold the described parts in assembly. To this purpose, each member has a connecting section which is aligned with a connecting section of the other member. Preferably, the connecting sections meet or abut. At least one of the connecting sections passes through the aperture of ledge 34 to couple and fix support body 26 with the socket members as well. As shown in FIGS. 3 through 8, socket member 40 has a tubular post 54 aligned with an outside opening 55 in that member. The end of post 54 is recessed as at 56. Socket member 41 has an internal tubular post 57 having a narrowed tip 58. The two posts are axially aligned so that when socket members 40 and 41 embrace about envelope 20 and meet face to face, the tip 58 of post 57 enters the recess 56 of post 54. This union takes place with either the two posts meeting within aperture 35 of ledge 34, or with one of the posts passing through aperture 35 and then joining the other post. Envelope 20 has opposed openings 38 to pass posts 54 and 57. A self-tapping fastener 60 passes through opening 55 in socket number 40 and the interior of tubular post 54 and threadably engages the interior of post 57 to secure all parts, including hook 52, in assembly.

The physical mounting and electrical connections to pins of tube 21 within end socket 25 at the opposite end of the assembly is the same as that described for the pins of the tube for end socket 24. Thus a support body 26*a* is identical in all respects to the support body 26 illustrated by FIGS. 2, 9, 10 and 11. Support body 26*a* similarly has passages to receive pins 23 of tube 21, fingers 28*a* which resiliently engage envelope 20, and a rearward ledge 34*a* having a transverse aperture to aid in holding the parts in assembly, all as described for end socket 24. Where parts of support body 26*a*, are illustrated corresponding to parts of support body 26, they are given the same reference number with the additional suffix "a".

End socket 25 also performs functions similar to those of end socket 24 but is enlarged in a lengthwise direction to accommodate starter switch means for the tube and incoming electrical leads together with the electrical connections involved. Socket 25 includes a pair of mating, plastic socket members 62 and 63. Each socket member is semi-circular and has a flat, rectangular face, shown at 64 and 65 respectively, which seat against each other when the socket members enclose this end of the fluorescent tube assembly. For this purpose face 65 of socket member 63 has projecting pins 66 which seat within recesses 67 correspondingly positioned on face 64 of socket member 62.

As shown especially by FIGS. 13 through 18, each plastic socket member 62 and 63 has a left-hand portion (as viewed in those figures) corresponding to socket members 40 and 41 of end socket 25, and a right-hand portion representing an enlargement to house other components. A bore 69 formed by the mating socket members is of a size to fit tightly around the outside of envelope 20. A bore 70 similarly formed at the other end of end socket 25 is smaller and of a size to receive incoming electrical leads 71.

Socket members 62 and 63 have reinforcing ribs 46 and connecting sections which meet to secure together that end of the assembly. Socket member 62 has a pair of tubular posts 72 and 73, each of which is aligned with an outside opening 74 and 75, respectively. The end of post 72 is recessed as at 76. Socket members 63 similarly has a pair of tubular posts 77 and 78, post 77 having a narrowed tip 80. Posts 72 and 73 are axially aligned with posts 77 and 78, respectively, so that when members 62 and 63 embrace about envelope 20 and meet face-to-face, the narrowed tip 80 of post 77 enters the recess 76 of post 72. Post 73 and 78 abut against each other. The union of posts 72 and 77 takes place with at least one of the posts passing through the aperture of ledge 34*a* of the support body 26*a*, or the posts 72 and 77 meet within such aperture. Envelope 20 has opposed openings 79 to pass posts 72 and 77. Self-tapping screws 81 pass through the outside openings 74 and 75 and the interiors of posts 72 and 73 while threadably engaging the opposed posts 77 and 78 to hold the parts of end socket 25 together.

The lengthwise extensions of socket members 62 and 63 define a handle H (FIG. 1) by which the fluorescent tube assembly can be conveniently handled and carried about and placed, as by hook 52, at a desired location. The lengthwise extension of socket member 63 also has a rectangular opening 83 in which a starter switch, generally indicated at 84, makes a snap fit and can be easily operated as desired from handle H. Switch 84 has a depressible button 85 and electrical leads 86 and 86*a*. The switch is of conventional construction normally used to start or extinguish the light of a fluorescent tube. As an example, a switch commercially available and designated Leviton No. 3382 can be used for this purpose.

Figure 20:
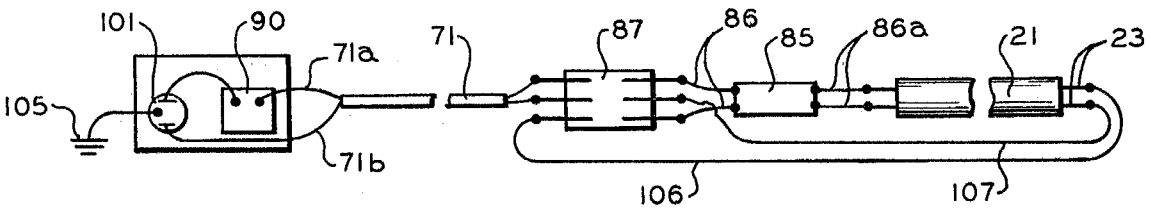
FIG. 20 is a wiring diagram which may be used for the tube and associated electrical parts.
Figure 12:
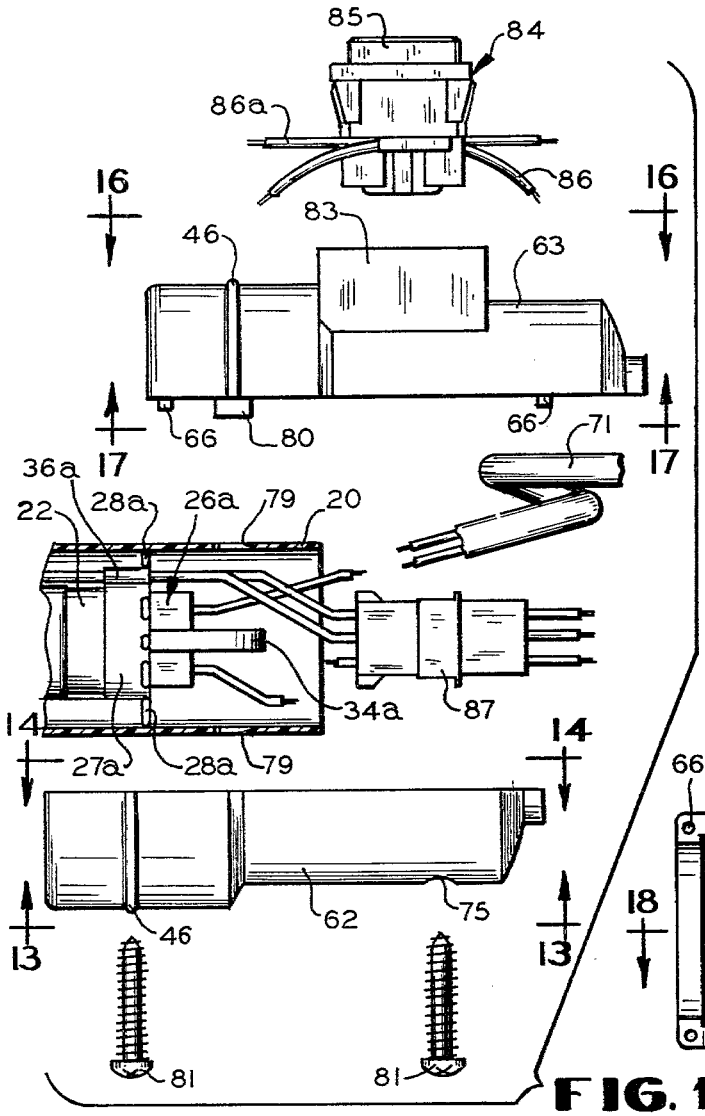
FIG. 12 is an exploded view, partially in section, of the right hand socket construction of the tube assembly of FIG. 1.
Figure 16:
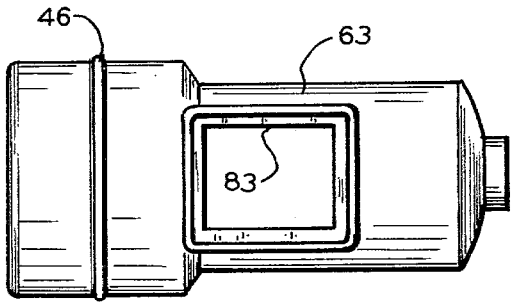
FIGS. 16 and 17 are sections of FIG. 12 on the planes of the lines 16—16 and 17—17, respectively.
Figure 17:
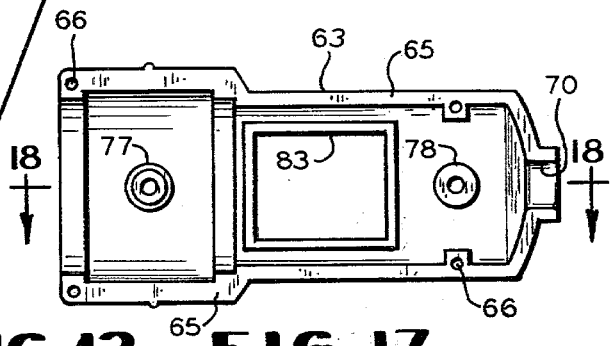
Figure 13:
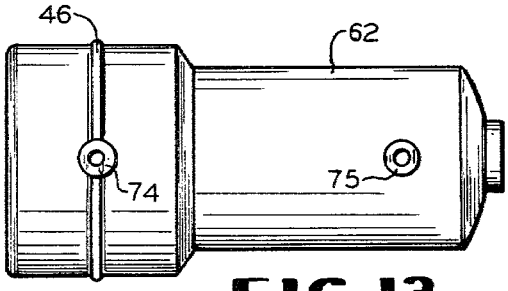
FIGS. 13 and 14 are sections of FIG. 12 on the planes of the lines 13—13 and 14—14, respectively.
Figure 18:
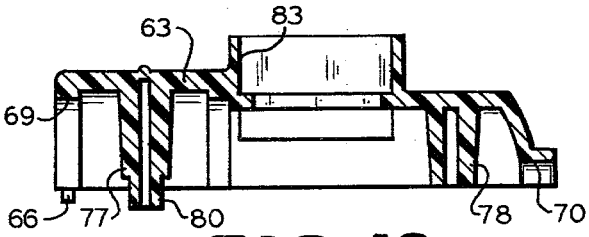
FIG. 18 is a section of FIG. 17 on the line 18—18.
Figure 14:
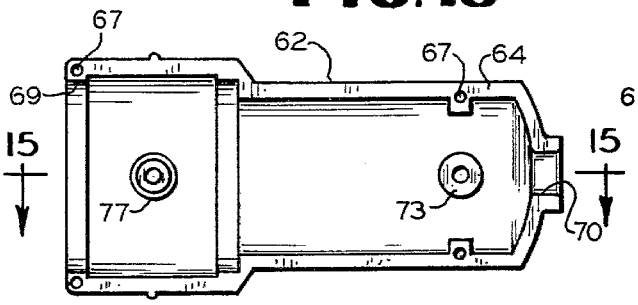
Figure 15:
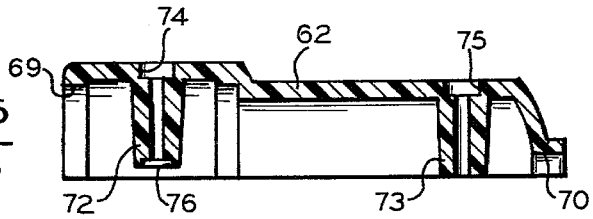
FIG. 15 is a section of FIG. 14 on the line 15—15.

The lengthwise addition to end socket 25 as compared to end socket 24 also houses incoming electrical leads and their electrical connections to switch 84 and tube 21. In the exploded view of FIG. 12, the incoming leads 71, switch 84 and its leads 86 and 86*a*, and a connector mate-and-lock box 87 are schematically shown. Box 87 is a standard, two-part connector of three male and female electrical jack connections, the two parts telescoping together and effecting union of the three jack connections. Such connector boxes are conventional and commercially available. As shown in FIG. 12, electrical leads from connector box 87 pass through an opening in side enlargement 36*a* of support body 26*a* and extend along the assembly between envelope 20 and tube 21. FIG. 20 illustrates a complete wiring diagram for the fluorescent tube assembly.

Figure 19:
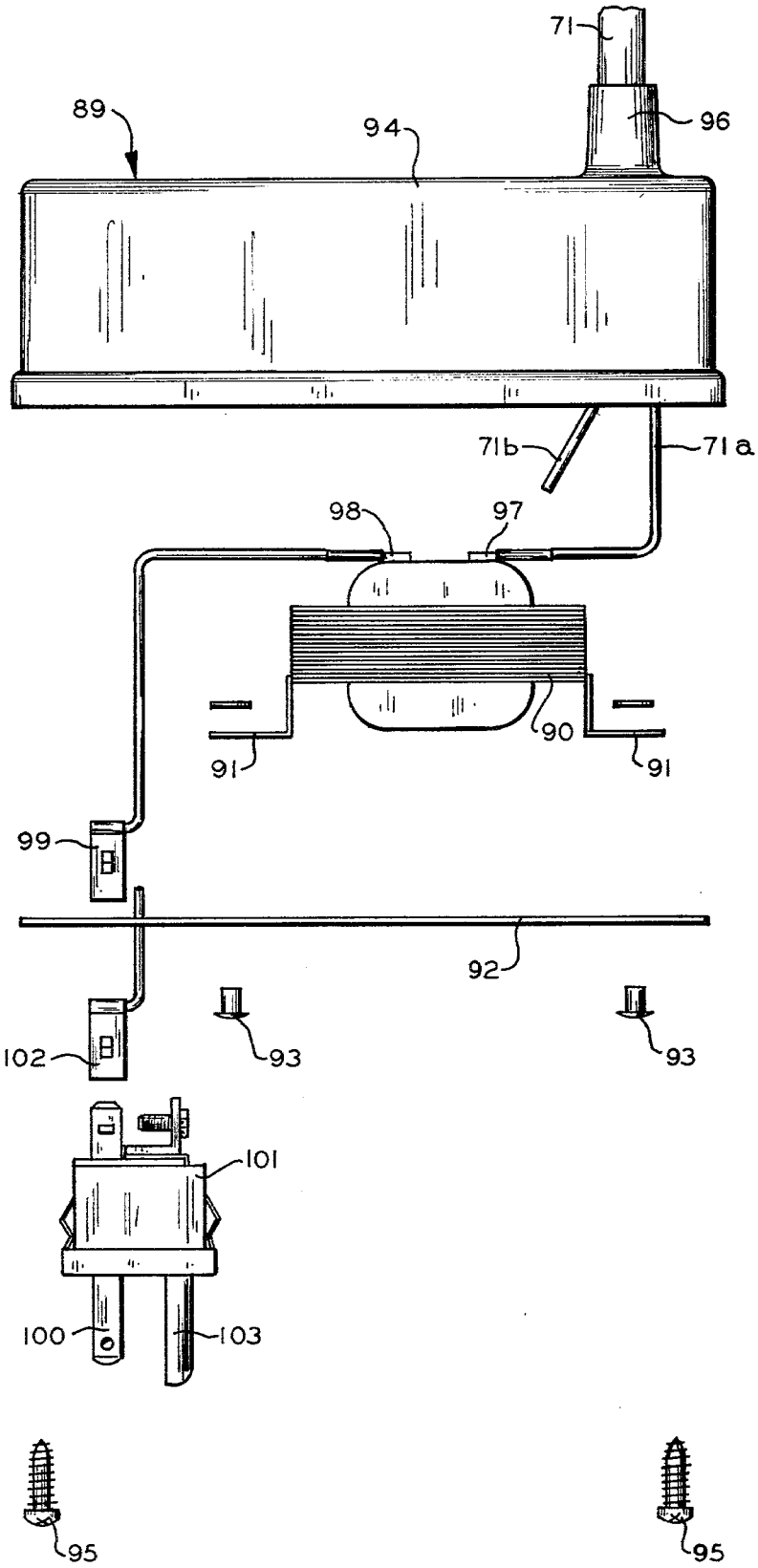
FIG. 19 is an exploded view of an integral unit forming part of the circuitry for the fluorescent tube which contains an electrical plug for connection to a source of electrical energy and ballast for the tube.

In accordance with the present invention, ballast for tube 21 is not connected in-line or close to the assembly but, to the contrary, at a relatively distant point to relieve the fluorescent tube assembly of bearing the weight of the relatively heavy ballast. Preferably, both the ballast and an electrical plug by which the entire assembly is energized are contained in one integral unit. FIG. 19 is an exploded view of one form such an integral unit may take. This unit, generally represented at 89, includes an open core transformer 90 having L-shaped legs 91 which are secured to a mounting plate 92 by rivets 93. A four-sided cover 94 fits about the transformer and is secured to base 92 by screws 95. Electrical leads 71 enter unit 89 through a boss 96 on the cover. One lead 71*a* is electrically connected through transformer 90 at 97 and 98 to a metal tab 99 of one prong 100 of a conventional three prong electrical plug 101. The other lead 71*b* is connected to a metal tab 102 of another prong of plug 101. The third prong 103 of plug 101 is for ground. When assembled, plug 101 is recessed within cover 94 and behind plate 92 so that only its prongs project therefrom for insertion into a source of electrical energy.

FIG. 20 illustrates one wiring diagram that may be used and electrically ties together tube 21, end sockets 24 and 25, switch 84, connector box 87, and the ballast and electrical plug of integral unit 89. Prong 103 of plug 101 is grounded at 105. Lead 71*a* is connected across transformer ballast 90 and joined with lead 71*b* to form insulated, incoming leads 71. Within end socket 25, leads 71*a* and 71*b* connect to two of the three entering connections of connector box 87. The third entering connection is connected via lead 106 to a pin 23 at the far end of the tube in end socket 24. Two of the three exiting connections of connector box 87 join through leads 86 to switch 85, while the third exiting connection through lead 107 connects to the remaining pin at the far end of tube 21 in end socket 24. The other two leads 86*a* of switch 85 join pins 23 at the adjacent end of tube 21.

Although the foregoing describes a presently preferred embodiment of the present invention, it is understood that the invention may be practiced in still other forms within the scope of the following claims.

We claim:

1. In a fluorescent tube assembly, an end socket therefor comprising a support body having openings adapted to make an electrical connection therein with said tube, a rearward extension on said body having an aperture, hollow socket members embracing said support body and having connecting sections axially aligned through said aperture of the support body, and fastening means extending through said connecting sections of the socket members and said body aperture to hold the end socket in assembly.

2. A fluorescent tube assembly comprising a light-transmitting envelope adapted to receive and carry a fluorescent tube having electro-connecting means at each end, a socket construction for each end of said envelope, at least one socket construction comprising a support body having passages adapted to receive said electro-conducting means and make an electrical connection therein, radially extending support fingers on said body, a rearwardly extending ledge on said support body having a transverse aperture, substantially cup-shaped socket members embracing said support body and meet along edges extending substantially parallel to the length of said envelope, said socket members having connecting sections extending substantially transversely to said length of the envelope, at least one of said connecting sections passing through said aperture in said ledge of the support body and being axially aligned with another connecting section, said connecting sections being hollow to accommodate therein fastening means to hold the socket construction in assembly.

3. The fluorescent tube assembly of claim 2 in which said envelope and support body are plastic.

4. The fluorescent tube assembly of claim 2 in which said at least one socket construction has hook means for suspending said fluorescent tube assembly.

5. The fluorescent tube assembly of claim 2 in which said socket members have mating portions to aid in the meeting and registering of said socket members with one another along said edges.

6. The fluorescent tube assembly of claim 2 including electrical leads extending to one socket construction and adapted to be electrically connected to said electroconnecting means of the tube in said passages, and further electrical leads extending from said at least one socket construction along said envelope to the other socket construction for electrical connection to the other end of said fluorescent tube.

7. The fluorescent tube assembly of claim 2 including electrical leads extending to one socket construction and adapted to be electrically connected to said electroconnecting means of the tube in said passages, and further electrical leads extending from said at least one socket construction along said envelope to the other socket construction for electrical connection to the other end of said fluorescent tube, and starter switch means connected with said one of said electrical leads and carried by one of said socket constructions.

8. The fluorescent tube assembly of claim 2 including electrical leads extending to one socket construction and electrically connected to said electro-connecting means of the tube in said passages, and further electrical leads extending from said at least one socket construction along said envelope to the other socket construction for electrical connection to the other end of said fluorescent tube, and starter switch means connected with said first mentioned leads and carried by said one socket construction, the free ends of said first mentioned leads being adapted to be connected to a source of electrical energy, and ballast means for the fluorescent tube contained in said electrical leads.

9. The fluorescent tube assembly of claim 8 in which said free ends of said first mentioned leads terminate in an electrical plug adapted to be connected to a source of electrical energy, said plug and ballast means being contained in one integral unit substantially to relieve the fluorescent tube assembly of bearing the weight of the ballast means.

10. A portable fluorescent tube assembly comprising:

(a) a fluorescent tube having electro-connecting pins projecting from each end, (b) a light-transmitting envelope disposed about the tube, (c) a socket construction for each end of the tube comprising:

(1) a support body having substantially parallel passages adapted to receive pins of said tube and make an electrical connection therein, (2) radially extending support fingers on said body adapted to engage said envelope and substantially center the socket construction with respect to said envelope, (3) a rearwardly extending ledge on said support body having a transverse aperture, (d) a pair of substantially cup-shaped socket members adapted to embrace said support body and meet along edges extending substantially parallel to the length of said envelope, said socket members having hollow connecting sections extending substantially transversely to said length of the envelope, at least one of the connecting sections passing through said aperture in said ledge of the support body and butting against another connection section, (e) fastener means extending through said connection sections of socket members and said body aperture to hold the socket constructions in assembly, (f) a housing extension on one of said socket constructions containing starter switch means, (g) electrical leads in said one socket construction containing said starter switch means and making electrical connection with said switch means and with pins of said fluorescent tube in said passages of the support body of said one socket construction, and (h) further electrical leads extending from said first mentioned electrical leads along said envelope to the other socket construction and making electrical connection with the other pins of said fluorescent tube in said other socket construction.

11. The portable fluorescent tube assembly of claim 10 in which said socket members have mating portions to aid in said meeting and registering of said socket members with one another along said edges.

12. The portable fluorescent tube assembly of claim 10 in which the free ends of said first mentioned electrical leads are adapted to be connected to a source of electrical energy, and including ballast means for the fluorescent tube connected in said first mentioned electrical leads.

13. The portable fluorescent tube assembly of claim 10 in which the free ends of said first mentioned electrical leads terminate in an electrical plug adapted to be connected to a source of electrical energy, and including ballast means for the fluorescent tube, said plug and ballast means being contained in one integral unit substantially to relieve the fluorescent tube assembly of bearing the weight of the ballast means.

14. The portable fluorescent tube assembly of claim 10 in which said envelope has a reflector section extending along its length.

* * * * *